United States Patent [19]

Larralde

[11] 4,098,491

[45] Jul. 4, 1978

[54] METHODS AND APPARATUS FOR THE CONTROL OF A SUSPENDED WEIGHT FROM A FLOATING VESSEL

[75] Inventor: Edward Larralde, Santa Barbara, Calif.

[73] Assignee: Vetco Offshore Industries, Inc., Ventura, Calif.

[21] Appl. No.: 539,618

[22] Filed: Jan. 9, 1975

[51] Int. Cl.[2] ..... B66D 1/48

[52] U.S. Cl. ..... 254/172; 91/390

[58] Field of Search ..... 254/172; 175/27; 60/463, 907; 91/364, 390, 359, 371, 370, 361, 363 R; 92/108, 110, 26

[56] References Cited

U.S. PATENT DOCUMENTS

| | | | |
|---|---|---|---|
| 2,375,946 | 5/1945 | Reichelt | 91/361 |
| 3,058,448 | 10/1962 | Wagner | 91/390 |
| 3,266,378 | 8/1966 | Shaw | 91/363 R |
| 3,385,169 | 5/1968 | Hale et al. | 91/390 |
| 3,508,400 | 4/1970 | Mercier | 60/463 |
| 3,529,422 | 9/1970 | Herndon, Jr. | 91/364 |
| 3,608,431 | 9/1971 | Pease | 91/361 |
| 3,646,754 | 3/1972 | Koch et al. | 91/361 |
| 3,693,939 | 9/1972 | Backson | 254/172 |
| 3,721,293 | 3/1973 | Ahlstone et al. | 175/27 |
| 3,804,183 | 4/1974 | Duncan et al. | 254/172 |
| 3,866,696 | 2/1975 | Larralde et al. | 175/27 |
| 3,895,780 | 7/1975 | Larralde et al. | 254/172 |
| 3,905,580 | 9/1975 | Hooper | 254/172 |

*Primary Examiner*—Trygve M. Blix
*Assistant Examiner*—Kenneth Noland
*Attorney, Agent, or Firm*—Subkow and Kriegel

[57] ABSTRACT

This invention relates to apparatus for the control of a weight suspended from a vessel employing a pneumatic suspension system subject to heave action so as to maintain the pressure in the pneumatic system substantially constant during the heave of the vessel as the result of the wave action.

13 Claims, 4 Drawing Figures

METHODS AND APPARATUS FOR THE CONTROL OF A SUSPENDED WEIGHT FROM A FLOATING VESSEL

BACKGROUND OF THE INVENTION

This invention relates to improvements in methods and apparatus for the control of a suspended weight from a floating vessel and is particularly directed to the control of forces imposed on the running string of a floating vessel employed in drilling, coring, running casing, reaming, cementing, testing, or other services in bore holes drilled in submarine environments where the vessel is subjected to wave or tidal action.

The particular and preferred object of this invention is to improve the operation of such systems. As is well known in the petroleum industry, the string, due to the great length above the drill collars, is a very flexible member subjected to considerable stretch due to its length and due to its own weight. The weight on the bit is less than the total static weight of the drill string imposed by the drilling lines as is well understood by those skilled in this art. The practice during drilling is to keep the drill pipe above the drill collars in tension. The drill collars act as a weight-producing element which exerts the load on the drill bit.

In certain of the systems of the prior art, this is accomplished by a gas pressure in an accumulator which pressurizes liquid in a hydraulic cylinder underneath the piston which supports the weight. The cylinder may be positioned to support a crown block or connected to the traveling block conventional in drilling derricks.

Wave action imposes a vertical oscillatory motion on the vessel which is imposed on a hydraulic cylinder resulting in variations in the tension in the drill pipe and perhaps in variation in the load imposed upon the drill bit, when this is employed or any other load connected to the piston rod. In the case of the hydraulic-pneumatic systems or pneumatic systems, the pressure on the liquid underneath the piston rod is maintained by gas pressure in an accumulator; such systems are shown in the Hanes et al. U.S. Pat. No. 3,714,995 and the Larralde et al. U.S. Pat. No. 3,718,316, and in U.S. Pat. No. 3,847,607.

Experience with such systems has shown that a variation in the lifting force of about ± 2% to ± 5% of the suspended weight may be experienced at each wave cycle under not unusual conditions, even when no drilling advance is maintained. With drill advancing during drilling, an additional force variation may occur. The results of these motions are that the pressure in the cylinder fluctuates and the degree of fluctuation increases as the drilling progresses.

In systems in which the suspended weight is supported in a pneumatic system which does not employ a liquid pressure transfer medium as in the former case, like load variation occurs.

Floating vessels operating as drilling vessels in the open sea may experience vertical motions, i.e., heave due to wave action ranging, for example, from as low as 2 inches to 20 feet or more trough to crest as, for example, has been experienced in the drilling of the North Sea. However, under ordinary conditions, the ships are on station and drilling when the heave is not more than about 10 to 15 feet. The wave action imposes a vertical displacement of the drilling vessel which in practical effect is sinusoidal. The period of such cycles has been reported in the range of 8 to 16 seconds but may be either greater or less.

The demand on the string will vary, depending on the services which they are to provide. Thus, for landing casing or instrument survey, it is desirable to hold the piston fixed in space at the desired level in order that the casing or instrument is not subject to displacement.

There is also another circumstance where it may become important that the piston be maintained at relatively stationary position in space. Thus, when the well suddenly develops a high pressure due to the production of gas and it becomes necessary to close the blow-out preventer, it becomes highly important that the drill string remain fixed in space and not oscillate in the closed blow-out preventer so as not to damage it.

During drilling, however, the drill is to be advanced at a controlled rate while maintaining a controlled weight on the bit. It is desirable to maintain a desired upper load limit on the bit in order that excessive stresses and torque are not developed which will be so large as to injure or even cause rupture of the drill pipe. On the other hand, it is desirable that the load on the bit be not reduced excessively so that the rate of advance is unreasonably reduced. Since the cost of operation of the drilling operation is materially affected by the drilling rate, it is desirable that the drilling rate be maintained at as high a rate as is consistent with safety. This is established by the driller based on his experience and the performance of the drilling operation under consideration. The driller sets the load required for the drilling advance to make the advance be at a satisfactory rate consistent with safety.

In the pneumatic systems, with or without a hydraulic transfer, during the heave cycle as the volume $V_0$ of the gas, effective at a pressure $p_0$, as the force-producing medium, varies as a function of the vertical motion of the cylinder, the resultant pressure $p_1$ due to a change in volume $\Delta V_0$, is given by the gas law.

$$p_1 = \frac{p_o(V_o)^k}{(V_o \pm \Delta V)^k} \qquad \text{Equation 1}$$

The power $k$ is the ratio of the specific heat of the gas at constant pressure divided by the specific heat at constant volume. For practical purposes, experience with such system has shown that it may be taken as Unity, since for practical purposes the system may be assumed to be operating under isothermal conditions. If temperature varies significantly, this variation may be taken into consideration by suitable modification of the value of "$k$." For purposes of illustrating the principles of my invention, "$k$" may be taken as having the value of unity. In going from the midpoint of the heave to the crest of the wave, this quarter of the cycle is termed the first quarter. The value $\Delta V_0$ is negative in the first and last quarter of each cycle and positive in the second and third as per above.

$$p_1 = \frac{p_o(V_o)}{(V_o - \Delta V_o)} \qquad \text{Equation 2}$$

In the second quarter the attained pressure is:

$$p_2 = \frac{p_1(V_o - \Delta V_o)}{(V_o - \Delta V_o + \Delta V_o)} = \frac{p_o V_o}{V_o} \qquad \text{Equation 3}$$

In the third quarter the attained pressure is:

$$p_3 = \frac{p_2 V_o}{(V_o + \Delta V_o)} = \frac{p_o V_o}{(V_o + \Delta V_o)} \quad \text{Equation 4}$$

In the fourth quarter the pressure attained is:

$$p_4 = \frac{p_3(V_o + \Delta V_o)}{V_o} = \frac{p_o V_o}{V_o} \quad \text{Equation 5}$$

It will be seen that the variation in the load, i.e., changes in the pressure during the heave, is diminished by making the volume $V_0$ sufficiently large. The value of $p_0$ is fixed by the design dimensions of the effective area of the piston and by the forces desired to be established. In practice these parameters are dictated by practical requirements. For practical purposes the volume of the gas has an upper limit and the variation in pressure will depend on the nature of the wave action.

Another limitation that such systems have arises from the fact that if the drill is to advance as in drilling the value of $\Delta V_0$ is changed by the volume change resulting from the advance during drilling.

The progressive increase in pressure during drilling results from the progressive decrease in volume resulting from the motion of the piston in the cylinder during the descent of the piston. The volume change in "$n$" cycles is symbolized by $n\Delta v$.

In the first quarter of any succeeding cycle the attained pressure is:

$$p_1 = \frac{p_o V_o}{V_o - \Delta V_o - (n + 1)\Delta v} \quad \text{Equation 6}$$

In the second quarter, the attained pressure is:

$$p_2 = \frac{p_o V_o}{V_o - (n + 2)\Delta v} \quad \text{Equation 7}$$

In the third quarter, the attained pressure is:

$$p_3 = \frac{p_o V_o}{V_o + \Delta V_o - (n + 3)\Delta v} \quad \text{Equation 8}$$

In the fourth quarter, the attained pressure is:

$$p_4 = \frac{p_o V_o}{V_o - (n + 4)\Delta v} \quad \text{Equation 9}$$

In such an operation, this variation repeats in each cycle of the wave.

The resultant variation in lifting force will, depending on the modulus of the running string, result in a cyclic variation in the stretch of the string. It may also result in a variation in the net weight imposed on the bit depending on the drag effect of the mud in the hole employed in drilling. Variation in drill bit loads results in impact loads which have a serious effect in reducing the "life" of the bit and to increase the frequency of "round trips" which increases the cost of drilling.

The value of ($n$) must be limited not only by the dimensions of the cylinder, but also so that the retained pressures do not become excessive. In order that drilling continue beyond the point, the system, including the cylinder and the piston, must be lowered. This may be done by adjusting the drilling lines so as to lower the cylinder and thus the running string to accommodate the advance.

EXAMPLE I

For the purpose of illustrating the magnitude of the variation in the forces imposed on the weight-supporting piston in the prior art devices such as is shown in the prior art patents referred to above, we may assume conditions which are not uncommon.

The conditions assumed are: Free weight of the running string, 200,000 pounds; a gas volume, cylinder plus accumulator, of 100 cubic feet; an effective piston area of 0.5 square feet; a cylinder motion of 5-foot amplitude (i.e., 10-foot heave).

The pressure at 0° of the sinusoidal motion of the cylinder ($p_0$) is thus:

$$p_0 = 200{,}000/(144 \times 0.5) = 2777.8 \text{ lbs./sq. in.}$$

Substituting the above values in Equations 2–6.

During the first quarter the attained pressure is 2,849 pounds per square inch and the force is raised to 205,130 pounds, i.e., a variation of 2.5%.

In the second quarter the original volume and pressure is restored and the force is restored.

In the third quarter the attained pressure is equal to 2,710 pounds, or 195,120 pounds, i.e., a variation of 5.1% from the crest of the heave to the trough.

In the fourth quarter the pressure and the force are restored.

EXAMPLE II

In the situation assumed in Example I, if it is desired to cause a lowering of the running string at a controlled rate, the variations discussed in Example I are aggravated. Such a condition occurs when drilling.

Assume in the case of Example I that the drill advances at a uniform rate of 72 feet an hour, or 0.02 feet per second. The volume change per quarter due to this advance is 0.025 cubic feet in one quarter, or 0.1 cubic foot per cycle.

Assume that the weight on the drill is to be maintained at 20,000 pounds. The net weight of 180,000 pounds will require a pressure of 2500 lbs./sq. in. At the end of "$n$" cycles of 10 seconds each, the volume is 100 − 0.1$n$ cubic feet.

If the deviation is to be limited to 2.5% and the downward movement of the piston in the cylinder is set at 15 feet, the drilling time before the drilling lines would need to be adjusted is every 4 minutes.

$$2500 \times 1.025 = (2500 \times 100)/(100 - 0.1\,n) = 2562.5$$

$$n = 24 + \text{ cycles or about 4 minutes.}$$

The practical requirement in drilling with such weight compensators requires that the lines must be adjusted frequently so as to maintain a reasonable weight on the bit. The technique of weight adjustment is thus quite similar to ordinary land operations.

In co-pending U.S. application Ser. Nos. 378,963 and 378,968, applicant, jointly with Glenn Robinson, disclosed a pneumatic hydraulic compensator in which the weight is connected as above to the piston in a hydraulic cylinder with the liquid under the piston in communication with a pneumatic accumulator under gas pressure. A desired force is maintained on the piston in the cylinder during the complete wave cycle. The result is that a predetermined load or a predetermined load variation on the drill can be maintained notwithstanding the amplitude or frequency or changes in the frequency or amplitude of the wave action. Where it is desired that the drill be advanced, the invention provides a control for the advance of the bit under a controlled load during the advance of the drill.

The force on the piston is controlled to hold the piston relatively fixed in space by modulating the volume of liquid in the cylinder accumulator system. However, the volume of the liquid in the hydraulic system is modulated so as to permit, a downward motion of the piston as in drilling, while the lifting force on the piston is maintained. In one embodiment of the pneumatic-hydraulic system which supports a weight and is subject to cyclic action, the force exerted in the hydraulic-pneumatic system is modulated by imposing said force by independently controlled hydraulic-pneumatic force applying means and varying the force imposed by at least one of the force-applying means by controlling the liquid volume to compensate for variations of force in another of them so as to maintain a substantially constant force on the piston.

STATEMENT OF THE INVENTION

I accomplish the objectives discussed above in a simplified manner and with a small expenditure of energy. I maintain the substantially constant lifting force on the load-supporting piston by modulating the pneumatic pressures, i.e., gas pressure, in the systems during the heave cycle so that the total lifting force exerted by the gas on the piston remains substantially constant.

These forces may be applied by exerting the gas pressure, directly or through a liquid force transfer medium employing the pneumatic-hydraulic system referred to in the aforesaid co-pending applications or as described in U.S. Pat. Nos. 3,714,995, 3,718,316, 3,847,607, 3,834,672 and 3,804,183. I modify the apparatus as described therein so it may function as described herein. In either case, whether or not the hydraulic transfer medium is employed, according to my invention the net force on the piston is modulated by control of the gas pressure, increasing the gas pressure from a higher pressure gas source or decreasing the pressure by venting the gas to a lower pressure, to compensate for changes in the volume of the gas associated with the piston due to the differential motion of the supporting piston and cylinder during the heave cycle.

I may, as described in the aforesaid co-pending applications, employ a load-supporting system including a main load-supporting piston and may, but need not, but preferably do employ a trim cylinder and piston which creates a force which in my preferred embodiment adds to the main load-supporting piston.

In carrying out my invention, the control of the pressure may either hold the load-supporting piston at a constant position in space, that is, relative to a fixed point such as the top of the marine riser, used in such environments, or it may permit the advance of the running string at the desired rate while maintaining a force on the piston substantially at the desired value.

When the trim cylinder creates a positive force adding to the force on the main load-supporting piston the number of cycles which may be traversed reaches a limit where the trim force is reduced to zero. Further progress of the drill will result in an excessive force on the load-supporting piston. In order to maintain a constant force, the pressure under the main supporting piston may be modulated as described above by bleeding pressure during the first and last quarter of a cycle and increasing the gas pressure during the second and third quarter.

In employing the trim cylinder-piston combination, I may employ a much smaller trim volume than is that associated with the main load-supporting piston-cylinder combination.

Since I am concerned only with trimming the load forces to compensate for the variations due to the cyclic heave and the drill advance when present, the trim cylinder may be of any convenient size. The main cylinder volume and the associated volume will depend on the pressure change which may be tolerated.

I may when the pressure in the trim cylinder is substantially zero and consequently the pressure in the main cylinder is alone substantially sufficient to supply the lifting force, inter-connect the high-pressure cylinder with the low-pressure cylinder. If the pressure is insufficient I may add gas at a higher pressure to raise the pressure to the desired level or bleed gas if the pressures are too high.

I accomplish my objective by obtaining a signal responsive to the force on the piston rod supporting said weight, comparing said signal with a signal corresponding to a standard which is responsive to a desired force on the piston rod and thus obtain an error signal. I independently add or decrease a portion only of the force exerted on the piston rod to reduce or ideally cancel the error signal by modulating the gas pressure. Where I do not employ a trim cylinder, the pressures on the load supporting piston is modulated to compensate for the changes in pressure due to the advance of the drill. When employing the trim cylinder, the compensation is effected by modulating the pressure in the trim cylinder.

DETAILED STATEMENT

This invention will be further understood by reference to the drawings of which:

Figure 1:
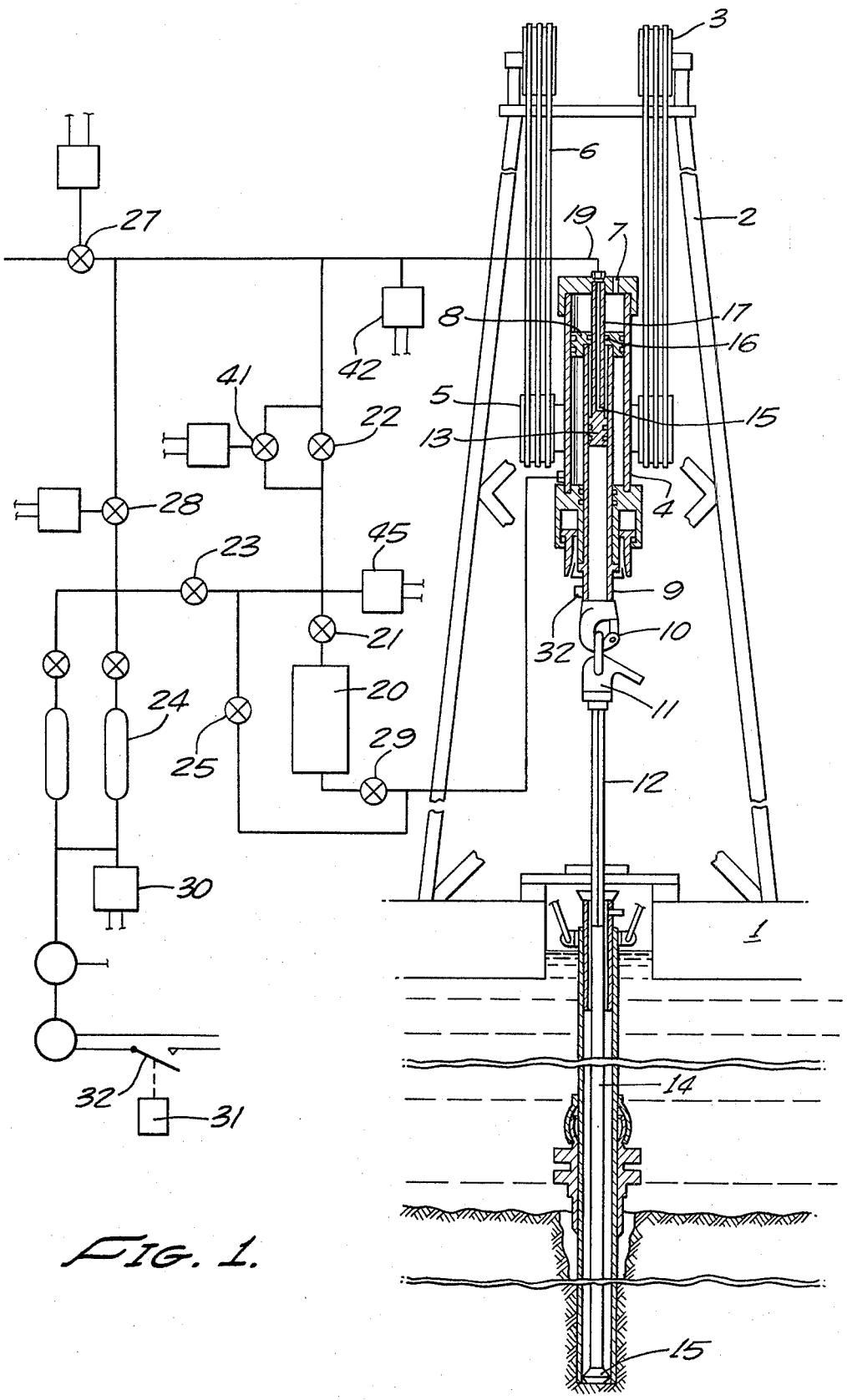
FIG. 1 is a somewhat schematic showing of the arrangement of the relations of parts of the system of my invention.

FIG. 1 shows the application of a control of my invention to an operation from a floating vessel 1 acting as the drilling platform. The convention derrick 2 mounted on the vessel carries the split crown block 3 from which the sheaves 5 are suspended by the drilling lines 6.

The sheaves 5 carry a cylinder 4, vented at 7, in which is positioned a piston 8 connected to a tubular piston rod 9 from which is suspended the conventional hook 10 which carries a swivel 11 and the kelly 12. The drill pipe 14 is connected to the kelly and to the drill collar which is connected to the bit 15. The casing is composed of the conventional marine riser and the bore hole casing assembly together with the usual drilling equipment.

The hollow piston rod carries a piston head 13 connected to the vented cylinder head by a closed-end tube 17 which passes through a seal 16 in the piston 8. The tubular member 17 is bored at 15 to provide a communication between the inlet 19 to member 17 and to annulus 18 between the tubular rod 9 and the tubular member 17. This cylinder and rod construction and its use as a weight control have been described in the aforesaid co-pending application, Ser. No. 274,880, of which the herein applicant is co-applicant and assigned to the assignee of this application. The aforesaid application is herewith incorporated in this specification by this reference.

Figure 3:
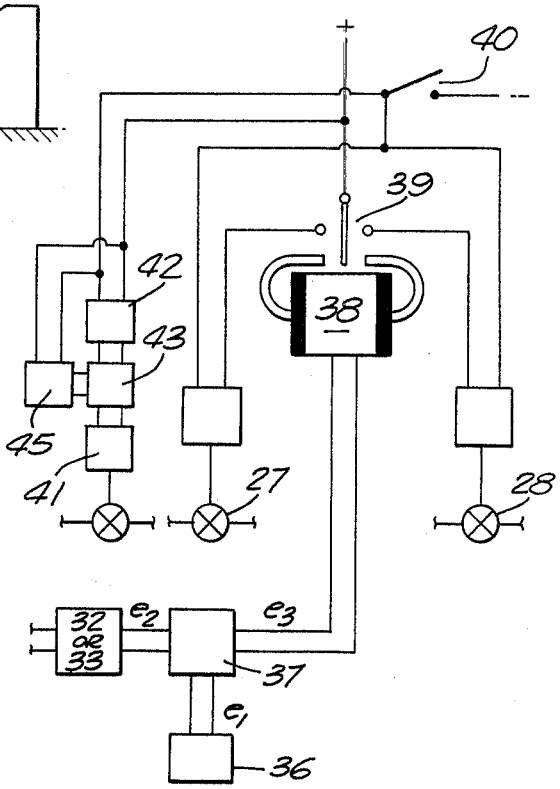
FIG. 3 is a schematic diagram of a control system of my invention.

FIG. 1 shows in schematic form a diagram which, together with the controls shown schematically in FIG. 3, illustrates the principles of my invention. In employing the system where the annulus 18 and the cylinder 4 act together as a single cylinder unit, the annulus 18 and cylinder 4 and accumulator 20 are interconnected through valve 21 and valve 22, valve 29 being open.

The main cylinder 4 and annulus 18 are connected via valve 23 and 22 and to a high pressure gas source 24 such as compressed air. The bypass valve 25 is closed. When the desired pressures are established, valves 27 and 28 are closed, as will be more fully described below.

I may, by opening valve 25 and closing valves 21 and 29, remove the accumulator from the system.

When using the system of FIG. 1, I prefer to employ the trim cylinder 18. In such case, where the desired pressures are established, I may by closing valve 22 and 23 isolate cylinder 4 from the source of gas pressure 24 and the vent valve 27, which vents to atmosphere.

The pressure of the gas in the pressure source 24 is maintained at a level substantially above the maximum pressures attained in the load supporting pneumatic system. The pressure sensor 30, together with the operator 31, acts to close the circuit through switch 32 whenever the regulator shows that the pressure in 24 falls below a fixed level. Such regulators are well known.

Figure 2:
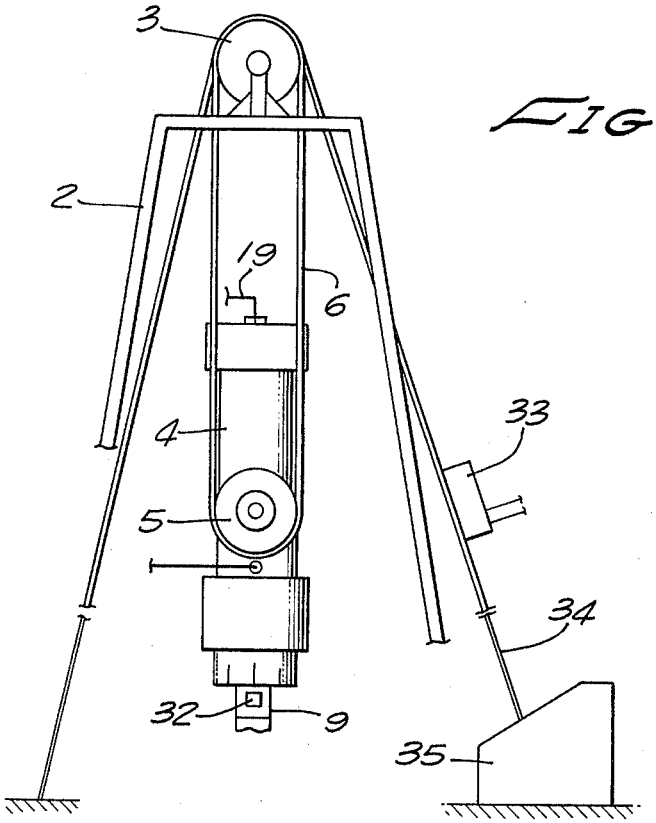
FIG. 2 is a fragmentary side view of FIG. 1.

The lifting force on the piston rod 9 may be sensed by a load cell 32 mounted on the piston rod 9, which reports a voltage output proportional to the strain in the rod. Such devices are well known in the art. Instead I may, and prefer to use a Tensiometer 33 (see FIG. 2). These are conventional devices used for measuring the load on the lines 6 in oil well operations. They are conventionally mounted on the fast line 34, which runs from the crown block 3 to the drilling hoist 35 in the conventional oil well rig.

The Tensiometer may be a direct reading device which gives a record of the pounds on the drill piston rod 9 or an electrical output in volts proportional to the load.

Thus I may weigh the running string with the bit off bottom and lower it to bottom and back off on the hoist 35 until the weight indicator 33 indicates the desired load. The difference is the weight on the drill. The voltage output of the Tensiometer 33 or the voltage output of the load cell 32 at that load becomes a reference value. This value ($e_1$) may be set into a constant voltage source 36. The fixed voltage $e_1$ is applied from a constant voltage source to the voltage comparator 37 (see FIG. 3), to which the output voltage $e_2$ of the Tensiometer 33 or the load cell 32 is applied. When the output $e_2$ equals $e_1$ the polarized relay 38 is de-activated and the switch 39 is open. The solenoid valve 27 is closed, as is the solenoid valve 28. The volumes associated with the annulus 18 and cylinder 4 are sealed.

If the load on the piston rod 9 is above the set level and $e_2$ is greater than $e_1$, the polarity of the net voltage $e_3$ is such as to cause the switch 39 to close the circuit on the solenoid valve 27, whereupon 27 opens, valve 22 remaining closed, and the operating pressures on the piston drops until the load signal $e_2$ becomes equal to the reference segment $e_1$. The relay opens the circuit on valve 27 which closes. If the effective pressure falls below that required to maintain the desired load, the voltage $e_2$ becomes less than $e_1$ and the polarity of the voltage $e_3$ reversed. The polarized relay moves to close the circuit through switch 39 to close the circuit on valve 28 while holding the circuit on 27 open. The pressure source is connected through valve 28 to the annulus 18 and valve 22 to the cylinder 4, causing effective pressure to rise until the reference load is established, whereupon both valves 27 and 28 close.

Where the system described above is operated effectively without the independent use of trim cylinder, I may charge both the cylinder 4 and the annulus 18 by opening valves 21, 22 and 23, valve 25 being closed. The circuit on the polarized relay being open at switches 40 and 46, valves 27 and 28 are closed. Valve 41 is closed since the pressure in the cylinder and annulus is in balance and remains closed as is described below. Pressure is established in 4 and 18, such that the desired force on the piston rod is established.

The force as measured in terms of pounds in the sensor 32 or 33 is the force to be established as that desired to be and the voltage $e_1$ is adjusted. As the vessel cycles during heave in the first quarter of the cycle as the vessel rises to the crest of the wave, the cylinder rises with respect to the pistons 8 and 13 and the volume of the fluid in the cylinder and in the annulus diminishes. The pressure rises. Valve 27 opens to vent the pressure until the voltage $e_2$ becomes equal to $e_1$ and valve 27 closes.

During the second and third quarters of the cycle as the vessel descends from the crest of the wave to the trough the cylinder moves downward, increasing the volume under the piston and pressure falls. As $e_2$ is less than $e_1$, the valve 28 is open while valve 27 is closed until $e_1$ is again equal to $e_2$ when valve 20 closes, valve 27 remaining closed.

The system thus withdraws gas from the annulus 18 and the cylinder 4 to reduce pressure to compensate for the tendency to increase the pressure therein during the period of the heave from the trough to the crest and adds gas to the system to increase pressure to overcome the tendency to decrease the pressure during the period of the heave from the crest to the trough. The increase or decrease in pressure is in an amount and under a pressure to maintain the total force on the piston substantially constant. The withdrawal or the addition is interrupted when the force in the piston, has reached a predetermined force at which the piston is to be supported. This operation will occur even though the descent of the piston from the drilling or other operations occurs. The criterion for the reduction of pressure or increase in pressure is the deviation of the force from a predetermined norm, which is the force desired to be maintained under the piston under the conditions which it is sought to maintain the piston.

Since according to the procedure in my process, pressure is continuously maintained in the cylinders 4 and 18 at the established pressure, the lines need not be adjusted to maintain the desired weight. The limitation is imposed by the length of the cylinder 4, the amplitude of the cylinder motion, and the rate of drill advance. This may be illustrated by a specific example which is given not as a limitation of my invention.

EXAMPLE III

In the cases assumed previously the number of cycles ($n$), and therefore the time between adjustment of the drilling lines, employing a cylinder which permits a piston movement of L feet is:

$$L = n \times 0.02 \times 2.5 = 0.05n \qquad \text{Eq. 10}$$

For example, a cylinder which permits a 15-foot stroke will permit drilling for 300 cycles or 3,000 seconds, i.e., 50 minutes before the lines must be adjusted. However, during this operation the lines will not require attention, assuming no leakage and the force is maintained constant.

At the end of the stroke of 15 feet, the volume is 100 − (15 × 0.5) = 92.5 cubic feet and the pressure in the first quarter of the 301 cycle will, unless compensated by my invention, increase to:

$$p_1 = (2500 \times 92.5)/(92.5 - 2.5) = 2569 \text{ lbs./sq. in.}$$

However, as the pressure during the quarter rises above the pressure at the start of the quarter, assumed to be 2500, the pressure of 2500 is restored.

The energy expended to maintain the pressure constant depends on the volume $V_0$ and the period of the wave and its amplitude. At the conditions assumed, the horsepower requirement is not substantial.

In the system in which the annulus 18 is used to trim the forces imposed on the main piston 8, the lifting force on the piston rod 9 need not be compensated by adjusting the pressure changes in the cylinder 4. The resultant force adjustment is obtained by the adjustment of the pressure in the annulus 18 so as to maintain the net force on the rod 9 substantially constant.

When using the trim cylinder, as described above, after charging the cylinder 4 and the annulus 15 to the desired pressure as described above, Valves 21, 23 and 25 are closed. The equal pressures sensed by sensors 45 and 42 establish insufficient voltage to actuate solenoid valve 41 and valve 41 remains closed. Valve 41 is opened when the pressure in 45 generates a signal voltage sufficiently in excess of the voltage output of the sensor 42 to actuate the solenoid valves, whereupon valve 41 opens. When the pressures in cylinder 4 and annulus 48 are equalized, valve 41 closes and remains closed until the aforesaid pressure difference is established.

In the system such as is shown in FIG. 1, the forces on the pistons 8 and 13 are additive.

The force F on the piston rod 9 is given by:

$$pa + p^1b = F/144 \qquad \text{Eq. 19}$$

Where $p$ is the pressure in pounds per square inch in the cylinder 4 and "$a$" is the effective area in square feet of the piston 8 and $p^1$ is the pressure in pounds per square inch in the annulus 18 and "$b$" is the effective area in square feet of the piston 13 and F is in pounds. Since $p$ will vary by a value $\Delta p$ during the various quarters, F will change unless the pressures are compensated as in my invention:

$$(p + dp)a + (p' + dp')b = F \pm dF \qquad \text{Eq. 11}$$

In the first quarter, with no advance of the running string, the forces are:

$$p_1a + p_1'b = F/144 \qquad \text{(See Equations 2–5)}$$

$p_1$ is the pressure in the cylinder in the first quarter and $p_1'$ is the pressure required in the annulus to maintain F.

Where the drill string is advanced, the volume associated with the cylinder is reduced in "$n$" cycles. The limit of the advance under this condition is attained when the volume of the gas associated with the cylinder 4 is reduced so that the pressure rises sufficiently to support the desired weight.

Where the string is advanced as in drilling and assuming the weight of 180,000 on the hook, the drill advance may continue for "$n$" cycles until, the pressure attained in the cylinder 4 is sufficient to itself sustain the reference weight.

EXAMPLE IV

Illustrating the operation according to this embodiment of my invention and employing the parameters assumed in the previous examples, the maximum pressure in the cylinder 4 and zero gage in the annulus 18 is attained during drilling with a lifting force of 180,000. The piston 8 is, as assumed, 0.45 square feet and the piston 13 is assumed to be 0.05 square feet.

For purposes of this comparison, it will be assumed that the piston 13 at the time of the start of the first quarter of the first cycle is 16 feet from the bottom of the cylinder so as to accommodate the 10-foot heave and provide for 15 feet of advance towards the bottom of the cylinder. The volume of the gas associated with the cylinder $V_0$ is 99.2 cubic feet to equal the 100 cubic feet assumed in the previous examples. The annulus volume under these conditions is 0.05 × 16 = 0.8 cubic feet.

As drilling progresses, the pressure in the cylinder 4 rises during the first and last quarter and the annulus pressure is progressively vented to maintain the net force on the piston rod at a substantially constant value. (See Equation 11.)

The pressure in the cylinder 4 at which it is alone sufficient to sustain 180,000 and the annulus pressure is reduced to zero gage is:

$$p \times 0.45 \times 144 = 180{,}000.$$
$$p = 2778 = \frac{2500 \times 99.2}{V}$$
$$V = 89.3$$
$$\text{Where } V \text{ is } 99.2 - n\Delta V$$

Under these conditions, the drill may advance:

$$99.2 - n\Delta V = 89.3$$
$$n \times .1 = 9.9$$
$$n = 99 \text{ cycles, or } 10.7 \text{ minutes.}$$

0.2 feet per cycle, an advance of about 20 feet, is permissible. Using a cylinder which permits of a 15-foot stroke, the assumed conditions requires a cylinder of 22 feet which permits an advance of 21 feet from the top of the heave at the assumed rate. Drilling may continue for 12.5 minutes before lines need adjustment. The system may be de-activated by opening switch 40, whereupon valves 27 and 28 close. Manual valves 22, 21, 29, and 23 are opened; valve 25 is closed.

At this point the pressure in the annulus 18 and the cylinder 4 are reestablished at 2500 pounds. Valves 23, 21 and 22 are closed and the operation repeats as above.

During the entire period of the advance of the running string the servo system has adjusted the pressure in the annulus by venting gas from the annulus during the quarter of each cycle when pressure rises above that to establish a substantial constant force F and adds pressure to the annulus to compensate for pressure drops during the cylinder 4 during second and third quarters.

The pressure demanded to be established in the annulus progressively decreasing during the advance of the running string, and adjusted to maintain a substantially constant value of F. (See Equation 11.)

The apparatus described above which permits an equalization of pressures between the annulus 18 and the cylinder 4 also permits of the reduction of the volume of gas associated with the cylinder 4. For example, the accumulator may be eliminated by means of the bypass. The reduction in volume results in a substantial reduction in the number of cycles and therefore drilling time before the annulus pressure is reduced to substantially zero, whereupon the lines need to be adjusted and pressures re-established as described above. While the system may operate without a contribution of force by the piston 13, the pressure will rise in the cylinder and increase the lifting force more than is tolerable. In such case the lines will be adjusted to permit resumption of advance as described above.

I prefer, however, to employ the system described above, whereby valve 41 opens and pressures are equilibriated and the advance of the drill string resumed. This is illustrated by Example V.

EXAMPLE V

In the case of a 15-foot stroke as assumed in Example IV, the volume of the cylinder at the beginning of the first cycle is:

$$0.5 \times 16 = 8 \text{ cu. ft.}$$

This assumes that the cylinder is 22 feet, to provide a safety factor to provide clearance at the limits of the cyclic movement of the cylinder. Assuming 8 cubic feet as $V_0$, the pressure in the cylinder to develop 2778 pounds so as not to require assistance from the annulus piston 13, is attained at the end of $n$ cycles.

The volume at which the pressure of 2778 lbs./sq. in. is attained is:

$$V = (2500 \times 8)/2778 = 7.2 \text{ cu. ft.}$$

This requires a diminution of the volume due to advance of the running string or:

$$7.5 - 7.2 = 0.3 \text{ cu. ft.}$$

The cubic feet reduction per cycle is 0.1 cubic feet per cycle. The reduction of 0.3 feet will occur in 3 cycles.

In the following first quarter the pressure in the cylinder rises above 2778 lbs./sq. in.

The volume at the end of the following quarter from the $7.2 - 0.5 \times 5 = 4.7$ cubic feet present at the end of the third cycle is:

$$p_2 = (2778 \times 7.2)/4.7 = 4225$$

The pressure is exceeded in the early part of the first quarter. In such case I may proceed with drilling without adjustment of the lines by opening valve 22 to interconnect the high pressure cylinder via the bypass valve 41. When the pressure in the annulus has vented through valve 27 so that the pressure in the annulus falls to zero, that is, when the pressure in the cylinder is sufficient to generate the force F and the signal $e_2$ equals $e_1$, valves 21 and 28 are closed. The sensor 42 senses the zero pressure in the annulus and causes the operator 43 to open valve 41.

The high pressure cylinder is vented into the annulus. When pressure is equalized as is sensed (see FIG. 3) by equal voltage outputs from pressure sensors 42 and 45, the voltage at the comparator 43 closes valve 41.

The valves 27 and 28 are adjusted responsive to the signal from 37 (FIG. 3) to either add or vent gas in order that the pressures in the annulus and cylinder reach that required to produce the signal $e_2$ equal to $e_3$ as described above.

At the conditions previously described, this will occur when the pressures are at 2500 pounds per square inch in the cylinder and annulus.

The groups of cycles are repeated as described above until the piston has reached the end of its stroke of 15 feet on the conditions assumed above, the force to support the running string remaining substantially constant.

Figure 4:
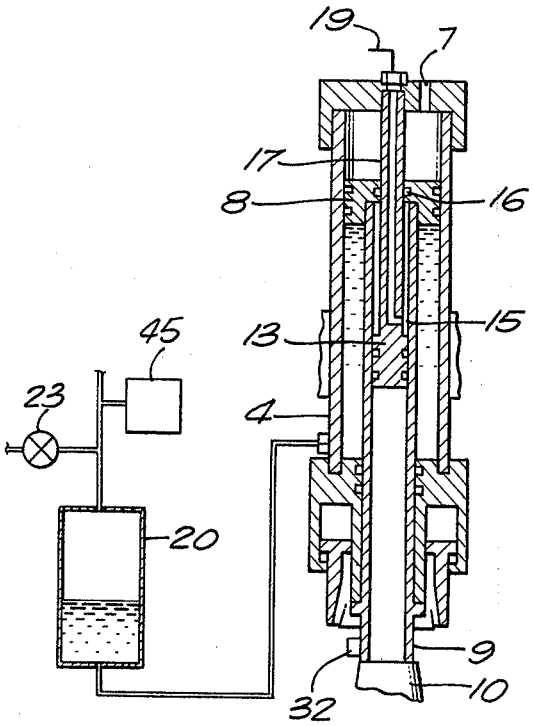
FIG. 4 is a fragment of FIG. 1, where an hydraulic transfer medium is employed.

The above operations will apply either to the purely pneumatic system of FIG. 1 or to the pneumatic-hydraulic system of FIG. 4, which may be visualized as including a fixed volume of liquid which fills cylinder 4 and is under gas pressure of the accumulator 20. The liquid being merely a force transfer medium between the gas under pressure in the accumulator and the piston 4. In such case, in order to have the same volume of gas associated with the cylinder, the size of the accumulator must be increased. In other respects, the system described above with the accumulator 20 in the system applies to this variation also. (See FIG. 4.)

One of the advantages of this pneumatic-hydraulic system is that the safety precautions described in the above patents relating to hydraulic-pneumatic weight compensators may also be employed in this variation.

While I have not recited the various devices and manipulations now employed with the weight compensators of the prior art, those skilled in the art will understand that they may be employed in connection with my invention.

The assumptions and examples discussed above are believed to be realistic in view of present conditions in marine operations. The actual values are as shown above dependent on the sizes of the cylinders and pistons employed, the magnitude and frequency of the heave and the volumes of the gases associated with the cylinders. It is believed that as explained above, those skilled in the art will be able to adjust their values to the practical conditions which they will encounter.

While I have described my invention as applied to loads imposed on a piston rod in cylinder means suspended from drilling lines, my invention has other applications. One example is in the application of a marine riser **14*a*, which is tensioned through lines 14*b* (see FIG. 1). The lines may be connected to a piston such as 9** and the cylinder, instead of being suspended in the derrick, is mounted on the vessel. The system of my invention is thus an improvement on the marine riser tensioning systems of the prior art, in which a conventional cylinder and piston combination is used as is illustrated in patents.

In such case, however, since no diminution in volume in the cylinders occurs, due to the advance of the drill, the modification employing the equalization of pressures between cylinder 4 and annulus 18, is not employed.

I claim:

1. An apparatus adapted for the use on a vessel, cylinder mounted on said vessel, a piston in said cylinder means to control the pressure in the cylinder, the improvement which comprises an accumulator connected to said cylinder, communication means adapted to pass gas under pressure from a source of gas under higher pressure to the said accumulator during that portion of the heave when the volume of the space in the cylinder under the piston tends to increase and communication means for withdrawing gas from the accumulator to space at lower pressure than in the accumulator to reduce the pressure in the accumulator during that portion of that heave when the volume of space in said cylinder under the piston tends to decrease, a control means for selectively opening communication between the accumulator means and said source and selectively closing communication between the accumulator and said space of lower pressure, said control means selectively closing communicaiton between the accumulator and said source when the communication between the accumulator and said space at lower pressure than in the accumulator is open, said control means comprising a signal means responsive to forces imposed in said cylinder on the piston, means to generate a signal responsive to the forces predetermined to be maintained on the piston, means to generate an error signal responsive to the differences between said first and second-mentioned signals and means to selectively open and selectively close aforesaid communications responsive to said error signal.

2. The apparatus of claim 1, a first pipe connection between the cylinder and said accumulator, a second pipe connecting said cylinder and accumulator to a source of gas under pressure higher than in the accumulator, a valve in said pipe connection, a third pipe connecting said accumulator to a space of lower pressure, a vent valve in said third pipe and control means to open and close the valves in said second pipe connection and means to close and open the valve in the third pipe connections.

3. The apparatus of claim 2, said control means, including means to sense the force on the piston in said cylinder, and said means to open and close said valves, including means to open the valve in said second pipe when the said force is substantially below a predetermined value and means to open the valve on the third pipe when the force exerted on said piston is substantially above said predetermined value.

4. The apparatus of claim 3, said control means comprising a signal means responsive to the forces imposed on the piston in said cylinder, said signal means including means to generate a signal responsive to the force on the said piston, means to generate a signal responsive to the forces predetermined to be maintained on the piston, means to generate an error signal responsive to the differences between said first and second-mentioned signals and means to selectively open and selectively close the aforesaid valves responsive to said error signal.

5. An apparatus adapted to be mounted on a vessel subject to heave due to wave action comprising a first cylinder, a first piston and a first piston rod in said first cylinder, means to connect a load to said first piston rod, a second cylinder and a second piston in said second cylinder; said second piston operatively connected to said first piston, means to apply a load to said piston rod, a source of gas pressure, means to introduce and maintain gas pressure in said cylinders, a first pipe system connecting each of the cylinders to said source of gas pressure and a second pipe system connected to each of said cylinders and to a space of lower pressure, valve means in said pipe systems, means to separately and alternately open one of said valves and close another of said valves, means to vary the pressure in said cylinders, to modulate the pressure in said first cylinder to compensate for change in pressure in said second cylinder on variation in load on said piston rod, whereby the forces on said piston rod are maintained substantially constant, said means to modulate said pressure including a control means for selectively opening said valve means between a first one of said cylinders systems and said source and selectively closing the first valve means in the pipe system between said first cylinder and said space and selectively closing the second valve means in the pipe system between another of said cylinders and said space when said first valve means is opened, said control means comprising a signal means responsive to the forces imposed on the first piston rod by said load when said apparatus is mounted on said vessel, means to generate a signal responsive to the forces predetermined to be maintained on the first piston rod by said load, means to generate an error signal responsive to the differences between said first and second-mentioned signals and means to open selectively and close selectively the aforesaid valve means responsive to said error signal.

6. In an apparatus adapted for use on a drilling vessel, subject to heave as a result of wave action and including a derrick, drilling lines suspended from said derrick, a plurality of cylinders, pistons in each cylinder, means to connect said cylinder to said drilling lines, said pistons connected to a piston rod, means for control of the forces in said piston rod by a load connected to the piston rod, comprising a plurality of pistons connected to the same piston rod, the improvement which comprises means to establish pressures separately under each of said pistons, said means including a cylinder for each piston, valved pipe connecting each of said cylinders to a source of gas pressure, valved pipe connecting each of said cylinders to a space at lower pressure, valved pipe means connecting said cylinders to each other, control means for connecting said cylinders to each other and to said source of gas pressure and control means to establish a predetermined force on said pistons, said means including means to connect selectively one of said cylinders to said source through said valved pipe means and to said space through said valved pipe means to compensate for changes in pressure in another of said cylinders.

7. The apparatus of claim 6, said control means comprising means to generate a signal responsive to the forces imposed on the piston rod, means to generate a signal responsive to a predetermined stress to be maintained in the piston rod, means to generate an error signal responsive to the differences between said first and second-mentioned signals, said means selectively to connect said one or the other of said cylinders to said source and to said space responsive to said error signal.

8. The apparatus of claim 6, said control means, including means to connect said cylinders, to each other when the pressure in one of said cylinders is at a predetermined pressure lower than in another of said cylinders to equalize the pressure in said cylinders.

9. The apparatus of claim 8, said control means upon said equalization of pressure closing said connection between said cylinders.

10. The apparatus of claim 9, said means to open and close said valves, including means to sense the force on the piston rod and means to sense the pressures in said cylinders and said means to open the valve in said pipe, to interconnect the said cylinders, said last-named means opening said last-named valve in said last-named pipe when the pressure in one of said cylinders is at a predetermined low point and upon equalization of said pressure closing said valve and said means opening and closing other of said valve means to adjust the pressure in cylinders to adjust the force on said piston rod to a predetermined value.

11. The apparatus of claim 10, said control means comprising a means to generate a signal responsive to the forces imposed on the piston rod, means to generate a signal responsive to a predetermined stress to be maintained in the piston rod, means to generate an error signal responsive to the differences between said first and second-mentioned signals, said means to connect selectively said other cylinders to said space, being responsive to said error signal.

12. An apparatus adapted to be mounted on a vessel subject to heave due to wave action comprising a first cylinder, a first piston and a first piston rod, a second cylinder and a second piston, said second piston operatively connected to said piston rod, a source of pressure, means to introduce gas from said source into each cylinder, said means comprising a first pipe system connecting said source to said first cylinder, a second pipe system connecting said source to said second cylinder, a first valve means in said pipe systems between said source and said cylinders, a third pipe system connecting said cylinders to a space at lower pressure, a second valve between said space and said cylinders, a fourth pipe system connecting said cylinders to each other, a third valve means in said fourth pipe system between said cylinders, control means to open said third valve, when the pressure in one of said cylinders is less than the pressure in another of said cylinders by a predetermined amount, said control means closing said valve means between one of said cylinders and said source and said one cylinder and said space, said control means, opening said first valve means between the other of said cylinders and said source, and to close the said valve means between said other cylinder and said space when the force on said piston rod is below a predetermined value and said control means, including means to close said valve means between said other cylinder and said source and open the valve means between said other cylinder and said space when the force on said piston rod is above a predetermined value.

13. In the apparatus of claim 12, said control means comprising a means to generate a signal responsive to the forces imposed on the piston rod, means to generate a signal responsive to a predetermined stress to be maintained in the piston rod, means to generate an error signal responsive to the differences between said first and second-mentioned signals, said means to connect selectively said other cylinder to said source and to said space, being responsive to said error signal.

* * * * *